US008324813B1

(12) United States Patent
Xiong

(10) Patent No.: US 8,324,813 B1
(45) Date of Patent: Dec. 4, 2012

(54) ELECTRONIC BALLAST WITH FREQUENCY INDEPENDENT FILAMENT VOLTAGE CONTROL

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 165 days.

(21) Appl. No.: 12/846,961

(22) Filed: Jul. 30, 2010

(51) Int. Cl.
*H05B 39/00* (2006.01)
*H05B 41/14* (2006.01)

(52) U.S. Cl. ..... 315/94; 315/97; 315/98; 315/DIG. 5; 315/DIG. 7

(58) Field of Classification Search ..... None
See application file for complete search history.

(56) References Cited

U.S. PATENT DOCUMENTS 5,703,441 A 12/1997 Steigerwald et al.
5,877,592 A 3/1999 Hesterman et al.
6,175,198 B1 1/2001 Nerone
6,359,387 B1 * 3/2002 Giannopoulos et al. ..... 315/46
6,366,031 B2 * 4/2002 Klien ..... 315/291
7,187,132 B2 * 3/2007 Bakre ..... 315/94
7,247,991 B2 7/2007 Chen et al.
7,586,268 B2 9/2009 Gawrys et al.
2008/0042588 A1 2/2008 Chan et al.

* cited by examiner

*Primary Examiner* — Anh Tran
(74) *Attorney, Agent, or Firm* — Waddey & Patterson, P.C.; Mark J. Patterson; Gary L. Montle

(57) ABSTRACT

An electronic ballast includes a filament voltage control block having first and second switches and configured to receive a filament voltage control signal. An inverter includes an inverter driver having first and second gate drive output terminals for driving first and second inverter switches, and a gate drive transformer having a primary side coupled to the inverter driver. A first secondary side is coupled to the first inverter switch and a second secondary side is arranged to drive the first switch in the control block. The control block is effective in response to a first control signal state to drive the switches in the control block and generate a lamp filament heating voltage, and is further effective in response to a second control signal state to disable the second secondary side of the gate drive transformer and thereby disable the lamp filament heating voltage.

19 Claims, 4 Drawing Sheets

ELECTRONIC BALLAST WITH FREQUENCY INDEPENDENT FILAMENT VOLTAGE CONTROL

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

BACKGROUND OF THE INVENTION

The present invention relates generally to program start and dimmable electronic ballasts for gas discharge lamps. More particularly, the present invention relates to an electronic ballast with integrated, frequency independent and controllable filament voltage drive circuitry.

Filament voltage control is highly important for fluorescent lamp life. A good filament control circuit should first have sufficient preheat capabilities prior to lamp ignition. The preheat voltage should not change with the number of lamps connected to the ballast.

Second, the filament control circuit should function to cut off the filament heating after ignition of the lamp if the lamp operates in a high current stage to save energy and improve the lamp efficiency.

Third, the filament control circuit should provide proper filament heating during a dimming phase according to the lamp requirements.

BRIEF SUMMARY OF THE INVENTION

An electronic ballast is provided in accordance with various aspects of the present invention to flexibly control the filament voltage for one or more discharge lamps during preheat, steady-state and dimming operation stages. Various secondary windings of a filament heating transformer are coupled to filaments for each lamp. The primary winding of the filament heating transformer is coupled to a filament voltage control block.

When a control signal in the control block is enabled during a preheat mode, a voltage Vdc/2 is provided at the primary winding, and a voltage Vdc/2N is provided at each secondary winding. When the control signal in the control block is disabled after startup, no voltage is provided across the transformer. When the control is modulated in accordance with a desired dimming value, a voltage D*Vdc/2 is provided across the primary, where D=the duty cycle of the control signal, and a voltage D*Vdc/2N is accordingly provided across each of the secondary windings of the filament heating transformer.

Briefly stated, the ballast in one embodiment includes a gate drive transformer coupled to the inverter driver. The gate drive transformer has a first secondary winding coupled to one of the inverter switches and a second secondary winding coupled to drive a first switch in the filament voltage control block. A second switch in the control block is also driven at the same frequency as the second inverter switch. When the control signal is high, an opto-coupler is enabled and the switches in the control block are able to be driven. When the control signal is low, the opto-coupler is disabled and subsequently the second secondary drive for the first switch is disabled as well.

DETAILED DESCRIPTION OF THE INVENTION

Figure 1:
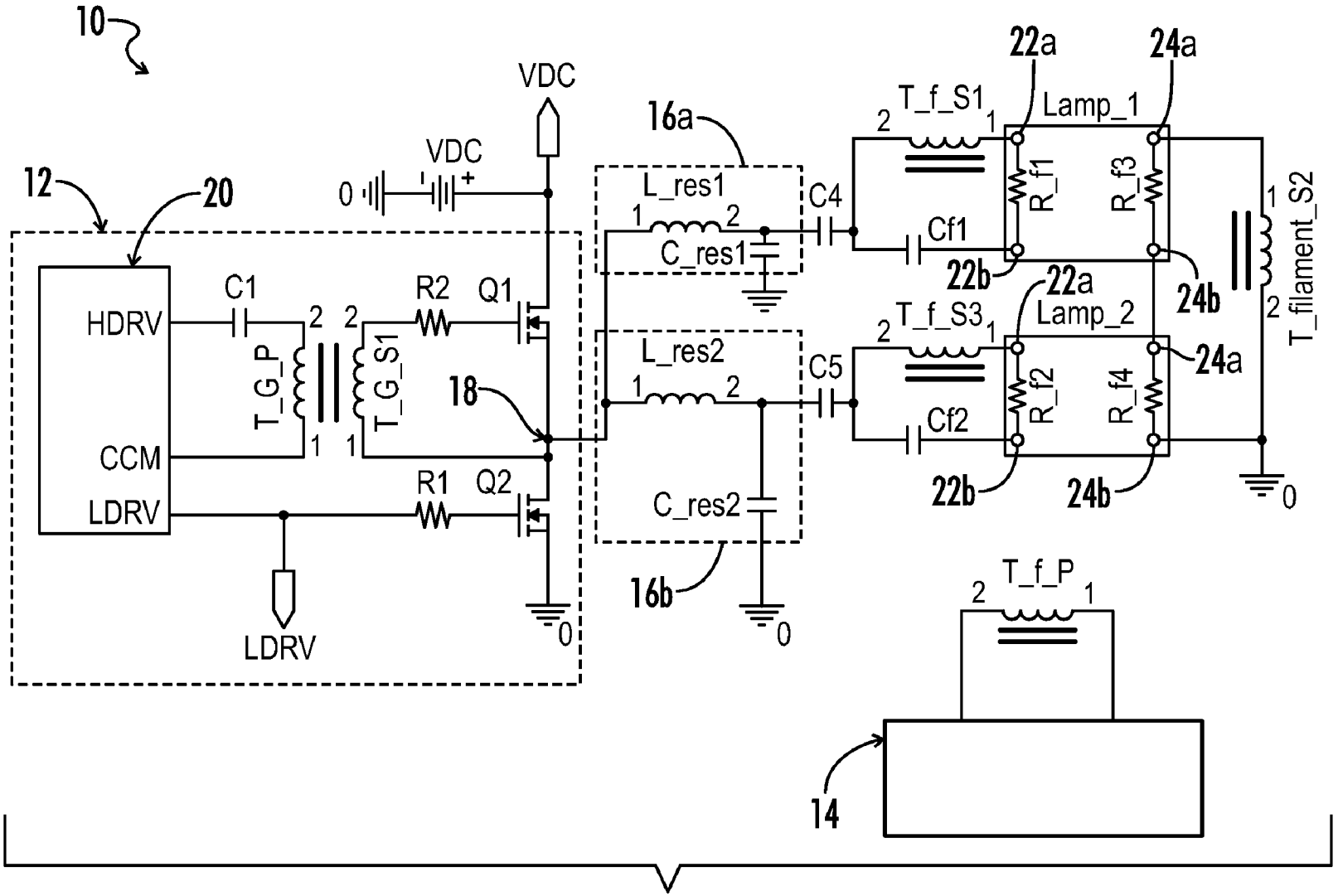
FIG. 1 is a circuit diagram showing an embodiment of the electronic ballast of the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The term "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

Referring generally to FIGS. 1-4, various embodiments of an electronic ballast for powering one or more discharge lamps in accordance with the present invention may be further described herein. Where the various figures may describe embodiments sharing various common elements and features with other embodiments, similar elements and features are given the same reference numerals and redundant description thereof may be omitted below.

In an embodiment of the present invention as shown in FIG. 1, an electronic ballast 10 includes an inverter circuit 12, a filament voltage control block 14, and one or more resonant tank circuits 16.

The inverter circuit 12 includes an inverter driver 20 used to drive a pair of inverter switches Q1, Q2 at a driving frequency which varies according to a ballast operating condition. The inverter driver 20 as shown includes a first output terminal from which a first (high side) gate drive signal HDRV may be provided to the first inverter switch, a second output terminal from which a second (low side) gate drive signal LDRV may be provided to the second inverter switch, and a third output terminal defining a common or ground connection COM.

In various embodiments the inverter circuit 12 further includes an isolated gate drive transformer T_g having a primary side T_g_p coupled between the first output terminal HDRV and the third output terminal COM and a first secondary side T_g_s1 coupled to the gate of the first inverter switch. A second secondary side T_g_s2 may in such embodiments be further provided in the filament voltage control block 14 as described below.

Each of the one or more resonant tank circuits 16*a*, 16*b* may be coupled in parallel with each other to a common node 18 defining an inverter output terminal 18 between the first and second inverter switches Q1, Q2. While two tank circuits 16*a*, 16*b* are shown in FIG. 1, the ballast configuration is not so limited and one or more tank circuits 16 may generally be provided within the scope of the present invention as may be understood by one of skill in the art. The one or more resonant tank circuits 16*a*, 16*b* may individually and independently further provide an inverter output branch to an associated discharge lamp, Lamp_1, Lamp_2. Each tank circuit 16*a*, 16*b* as shown further includes a resonant inductor L_res1, L_res2 and resonant capacitor C_res1, C_res2.

The ballast 10 further includes a filament heating transformer T_f for providing voltage across ballast output terminals 22, 24 configured to receive discharge lamps to be powered by the ballast 10. Discharge lamps Lamp_1, Lamp_2 may be coupled on a first end to a first pair of output terminals 22 and on a second end to a second pair of output terminals 24, whereby lamp filaments R_f1, R_f2 on the first end of the lamps may be heated by filament heating voltage provided across the first pairs of output terminals 22 and lamp filaments R_f3, R_f4 on the second end of the lamps may be heated by filament heating voltage provided across the second pairs of output terminals 24.

In an embodiment as shown in FIG. 1, a secondary winding T_f_s1 of the filament heating transformer T_f may be coupled on a first end to a first tank circuit 16*a* and coupled on a second end to a first output terminal 22*a* of the first pair of output terminals 22. A lamp current limiting capacitor Cf1 may be coupled on a first end to a node between the secondary winding T_f_s1 of the filament heating transformer T_f and on a second end to a second output terminal 22*b* of the first pair of output terminals 22. Another secondary winding T_f_s3 of the filament heating transformer T_f may be coupled to the second tank circuit 16*b* in like manner as shown in FIG. 1. A secondary winding T_f_s2 of the filament heating transformer T_f is further coupled in parallel with a series circuit made up of each of the second pairs 24 of output terminals.

A primary winding T_f_P of the filament heating transformer T_f is electrically coupled to the filament voltage control block 14 and magnetically coupled to each of the secondary windings T_f_s1, T_f_s2, T_f_s3 of the filament heating transformer T_f.

Figure 2:
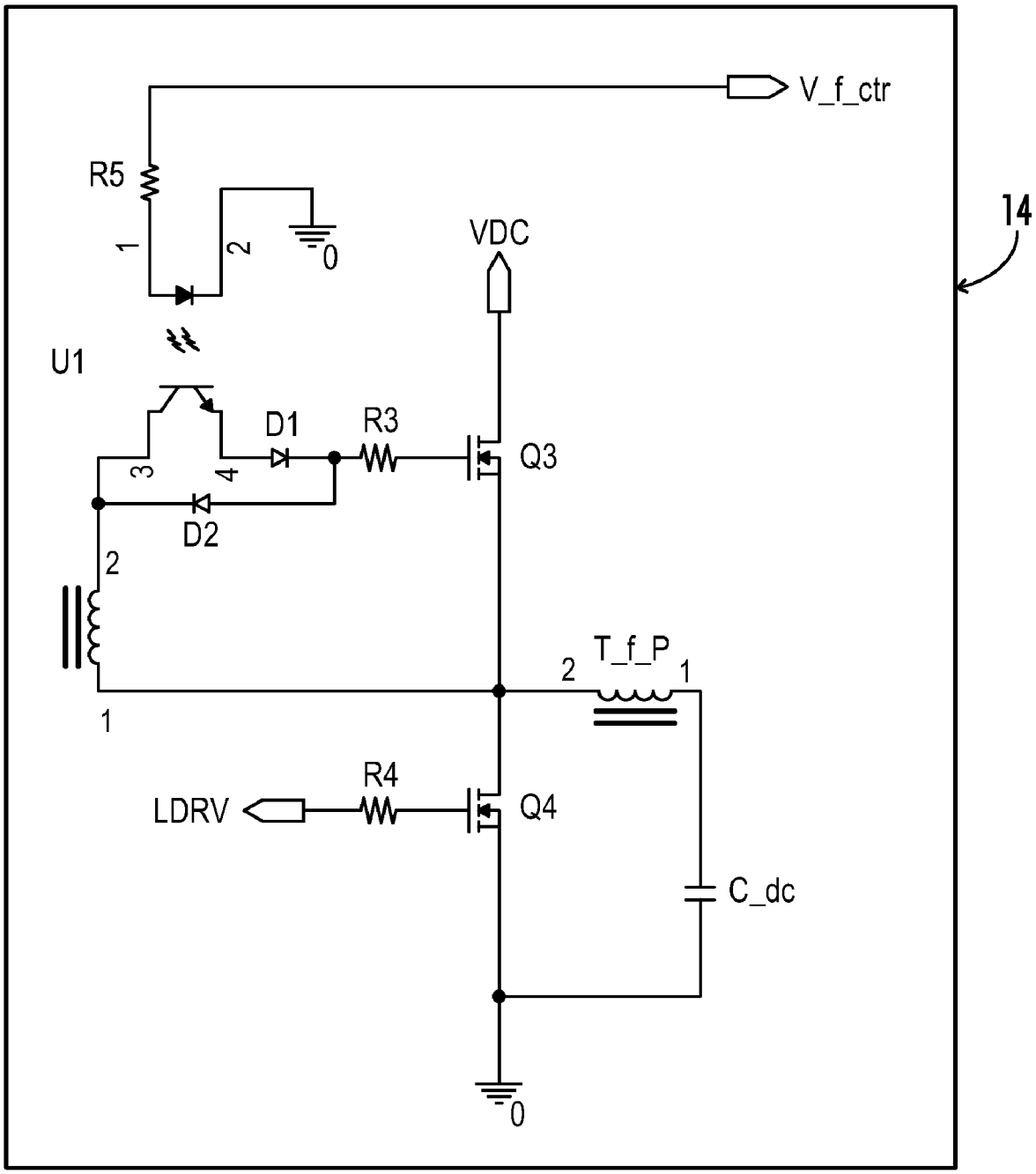
FIG. 2 is a circuit diagram showing an embodiment of a filament voltage control block of the ballast of FIG. 1.

Referring now to FIG. 2, in an embodiment the filament voltage control block 14 includes first and second switches Q3, Q4 effective to generate an output voltage across the primary winding T_f_P of the filament heating transformer T_f. The second secondary winding T_g_s2 of the gate drive transformer T_g is coupled on a first end to a node between the first and second switches Q3, Q4. The drain of the first switch Q3 is coupled to a voltage source Vdc, the source of the first switch Q3 is coupled to the drain of the second switch Q4, and the source of the second switch Q4 is coupled to ground.

A third switching element is coupled between a second end of the second secondary winding T_g_s2 of the gate drive transformer T_g and the gate of the first switch Q3. In the embodiment shown, the third switching element U1 is an opto-coupler U1 further coupled to a control signal input terminal and responsive (turn on and off) to control signals V_f_ctr provided to the filament voltage control block 14 via the control signal input terminal, thereby enabling and/or disabling gate drive signals provided from the second secondary winding T_g_s2 of the gate drive transformer T_g to the gate of the first switch Q3.

A first diode D1 is coupled between the opto-coupler U1 and the gate of the first switch Q3 to prevent reverse current flow. A second diode D2 and a resistor R3 are coupled in series between the gate of the first switch Q3 and the second end of the second secondary winding T_g_s2 of the gate drive transformer T_g to discharge gate voltage through the resistor R3.

The gate of the second switch Q4 is coupled to a node between the low side gate drive terminal LDRV of the inverter driver 20 and the second inverter switch Q2, whereby equivalent gate drive signals LDRV may be received by the second inverter switch Q2 and the second switch Q4 in the filament voltage control block 14.

Referring generally to FIGS. 1-4, a method of operation 100 in accordance with various embodiments of the present invention may be further described.

In a first step 102, power is supplied to an electronic ballast 10 having a configuration consistent with various embodiments as previously described. In a second step 104, an operating condition for the ballast 10 is determined. The inverter driver 20 is configured to provide pulse width modulated (PWM) gate drive signals HDRV, LDRV in accordance with the determined operating condition, and the filament voltage control block 14 is also configured to enable or disable PWM gate drive signals to the first switch Q3 and thereby control a filament heating voltage in accordance with the determined operating condition.

In an embodiment as shown in FIG. 2, the filament voltage control block 14 receives a control signal V_f_ctr from an external source such as, for example, a dimming controller which directs the enabling and disabling of the gate drive signals. In various embodiments the filament voltage control block 14 may further include a microcontroller or equivalent circuitry to determine the operating condition based on feedback from other portions of the ballast 10 and provide control signals to enable or disable the gate drive signals. The structure by which the inverter driver 20 determines the operating condition is not shown or otherwise described herein as various systems and methods for providing such information, such as lamp output sensors and feedback circuitry, are well known in the art.

Where the operating condition is a preheat condition associated with power being first supplied to the ballast, the method continues to step 106 and the inverter circuit 12 typically starts at a high frequency (i.e., 150 kHz) to obtain a very small voltage across the discharge lamps and avoid premature lamp breakdown.

In step 108, the control signal V_f_ct1 is in a first control signal state (i.e., high) and opto-coupler U1 is enabled such that the second secondary winding T_g_s2 of the gate drive transformer T_g may drive the first switch Q3 of the filament voltage control block 14. The low side gate drive signal LDRV also drives the second switch Q4 of the filament voltage control block 14, and as a result the voltage drop on the primary winding T_f_P of the filament heating transformer T_f may be a square wave whose peak voltage is Vdc/2. Each secondary winding T_f_s1, T_f_s2, T_f_s3 of the filament heating transformer T_f will have the same voltage waveform with an amplitude of Vdc/2N, where N is the turns ratio between the primary winding T_f_P and the particular secondary winding T_f_s.

Upon enabling the opto-coupler U1 such that a maximum filament heating voltage Vdc/2N is provided across the associated ballast output terminals (and thereby across the coupled lamp filaments), the method returns to step 104.

Where the operating condition is a lamp startup (i.e., ignition) condition, the method 100 continues to step 110 and the inverter circuit 12 reduces the driving frequency from the first high frequency associated with the preheat condition to a second lower frequency wherein a high voltage is generated by the resonant tank circuit and provided to the lamp to cause lamp breakdown and ignition. While the startup condition is underway, the voltage across the primary winding T_f_P of the filament heating transformer T_f will not change with the driving frequency from the inverter 12. Therefore in step 112 the maximum filament heating voltage is maintained across each of the discharge lamp filaments coupled to ballast output terminals.

After the startup condition has begun and the driving frequency has been reduced to cause lamp breakdown, the method returns to step 104.

Where the operating condition is a full lighting condition, or in other words lamp breakdown has been achieved and the one or more discharge lamps coupled to the ballast output terminals have been ignited, the driving frequency of the gate drive signals is further adjusted by the inverter driver in step 114 to achieve a steady-state current through the discharge lamps. When the lamp current is high enough, no filament heating is necessary. Therefore, in step 116 the control signal V_f_ct1 may be changed to a second control signal state (i.e., low) to disable the opto-coupler U1 and prevent gate drive signals from the second secondary winding T_g_s2 from driving the first switch Q3 of the filament voltage control block 14. As a result, no voltage will be generated across the primary winding T_f_P of the filament heating transformer T_f because the first switch Q3 is permanently disabled and filament heating cut-off is thereby realized.

Once a full lighting (i.e., steady-state) condition has been established the method returns to step 104.

Where the operating condition is a dimming condition, the inverter driver 20 in step 118 adjusts the driving frequency (Fdrv) to reduce the lamp current in accordance with a desired dimming level as known in the art. The inverter driver may generally receive a dimming command from an external source to determine the desired dimming level, but various methods of determining the dimming level may be anticipated within the scope of the present invention and are not described further herein.

During dimming conditions, the discharge lamps typically require some filament heating to support the arc current and improve the lamp life. In step 120, and with reference to FIGS. 3*a*-3*c*, the filament heating control block 14 functions in response to control signals V_f_ctr to modulate the gate drive signals to the first switch Q3 and generate a filament heating voltage across the primary winding T_f_P of the filament heating transformer T_f between a maximum filament heating voltage (i.e., fully enabled switching) and a minimum filament heating voltage (i.e., disabled switching).

Figure 3A:
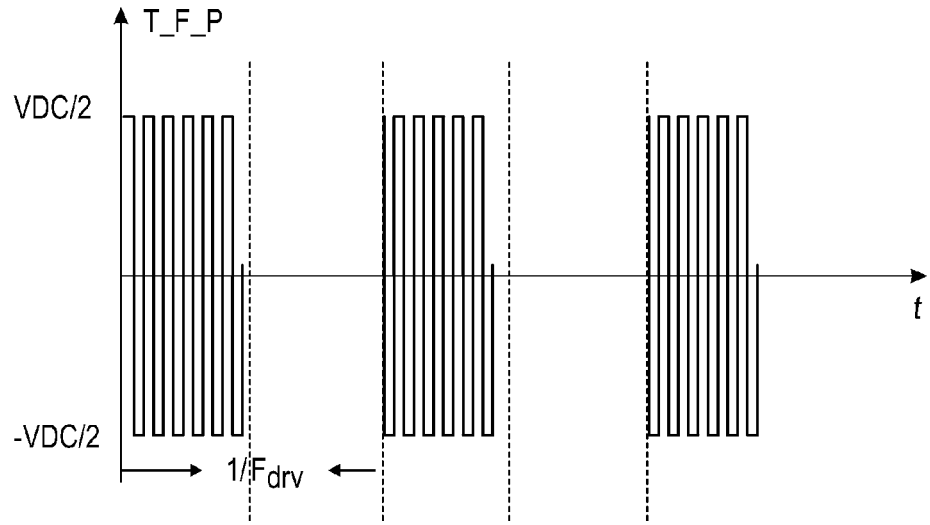
FIG. 3*a* is a waveform diagram demonstrating an example of a voltage across the filament drive transformer primary side of the ballast of FIG. 1, with respect to time.
Figure 3B:
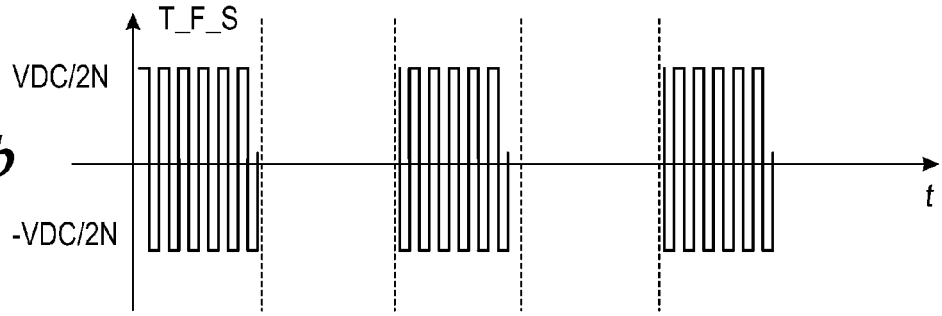
FIG. 3*b* is a waveform diagram demonstrating an example of a voltage across the filament drive transformer secondary side of the ballast of FIG. 1, with respect to time.
Figure 3C:
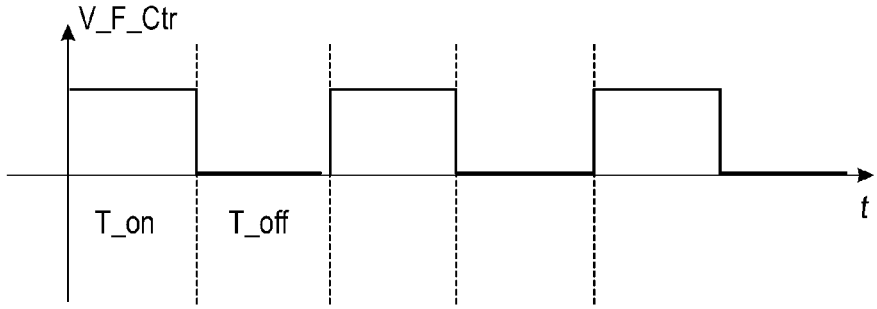
FIG. 3*c* is a waveform diagram demonstrating an example of control signals for the filament voltage control block of the ballast of FIG. 1, with respect to time.
Figure 4:
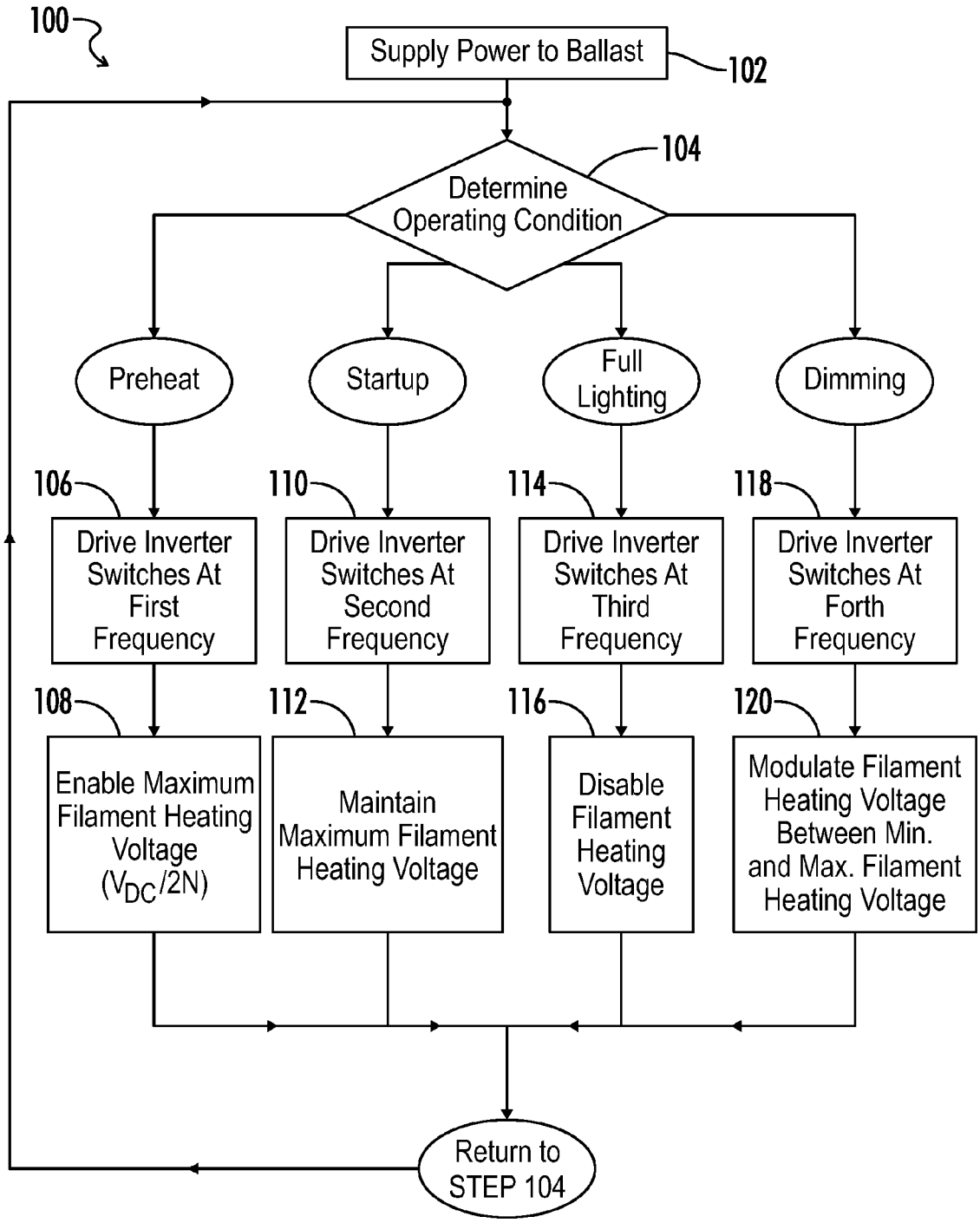
FIG. 4 is a flowchart showing an embodiment of a method of operation for an electronic ballast of the present invention.

When the control signals V_f_ctr are in a first control state (i.e., high) as previously described, whether determined by the filament voltage control block internally or via an external source, the filament voltage control block 14 is enabled and the voltage across the primary winding T_f_P of the filament heating transformer T_f is Vdc/2 as shown in FIG. 3*a* with respect to time. Accordingly, the voltage generated across the discharge lamp filaments coupled to the ballast output terminals is Vdc/2N as further shown in FIG. 3*b* with respect to time. By adjusting the duty ratio, or on/off time (T_on and T_off) of the control signal V_f_ctr a modulated filament voltage can be obtained as shown in FIG. 3*c*. The RMS voltage across the filaments would be around D*Vdc/2N, where D is the duty ratio equivalent to T_on/(T_on+T_off).

Different voltages may be obtained by adjusting the control signal V_f_ctr duty ratio (D). The filament heating voltage may further be accurately controlled by the filament voltage control block in accordance with different dimming current levels and using PWM voltage control.

The previous detailed description has been provided for the purposes of illustration and description. Thus, although there have been described particular embodiments of the present invention of a new and useful "Electronic Ballast with Frequency Independent Filament Voltage Control," it is not intended that such references be construed as limitations upon the scope of this invention except as set forth in the following claims.

What is claimed is:

1. An electronic ballast comprising:

a filament voltage control block comprising first and second switching elements and configured to determine a filament voltage control state;

an inverter circuit further comprising an inverter driver having first and second gate drive output terminals;

first and second inverter switches, the second inverter switch coupled to the second gate drive output terminal;

a gate drive transformer having a primary side coupled to the inverter driver, the gate drive transformer further having a first secondary side coupled to the first inverter switch and a second secondary side coupled to drive the first switching element in the filament voltage control block;

wherein the filament voltage control block is effective in a first filament voltage control state to drive the first and second switching elements in the control block and generate a lamp filament heating voltage, and wherein the filament voltage control block is effective in a second filament voltage control state to disable the second secondary side of the gate drive transformer and thereby disable the lamp filament heating voltage.

2. The ballast of claim 1, wherein the filament voltage control block is effective in a third filament voltage control state to modulate gate drive signals to the first switching element in the control block and generate a lamp filament heating voltage between a minimum and a maximum lamp filament heating voltage.

3. The ballast of claim 2, wherein the gate drive signals are modulated at a duty ratio corresponding to the desired lamp filament heating voltage.

4. The ballast of claim 1, the filament voltage control block further comprising a third switching element coupled on a first side to the gate of the first switching element and on a second side to the second secondary of the gate drive transformer, the third switching element further arranged to be turned on in response to a first control state wherein the second secondary of the gate drive transformer drives the first switching element, and turned off in response to a second control state wherein the first switching element is disabled.

5. The ballast of claim 4, the third switching element further comprising an opto-coupler.

6. The ballast of claim 4, the gate of the second switching element coupled to the second gate drive output terminal of the inverter driver, and wherein the first and second switching elements of the filament voltage control block are driven at the same frequency as the inverter switches.

7. The ballast of claim 6, the filament voltage control block further comprising a primary winding of a filament heating transformer coupled to a node between the first and second switching elements of the filament voltage control block, and wherein a voltage generated across the primary winding of the filament heating transformer is independent of the driving frequency of the first and second switching elements.

8. The ballast of claim 7, further comprising one or more resonant tank circuits having a first end coupled to an inverter output terminal between the first and second inverter switches, each tank circuit coupled on a second end to one of a plurality of secondary windings of the filament heating transformer.

9. An electronic ballast comprising:

a filament voltage control block comprising first and second switching elements;

first and second inverter switches;

an inverter driver comprising a first gate drive output terminal configured to provide gate drive signals to the first inverter switch and the first switching element of the filament voltage control block, and a second gate drive output terminal configured to provide gate drive signals to the second inverter switch and the second switching element of the filament voltage control block;

wherein the filament voltage control block is effective during a preheat condition, to enable the gate drive signals from the first gate drive output terminal to the first switching element of the filament voltage control block and generate a maximum lamp filament heating voltage, during a full lighting condition, to disable the gate drive signals from the first gate drive output terminal to the first switching element of the filament voltage control block and generate a minimum lamp filament heating voltage, and during a dimming condition, to modulate enabling and disabling of the gate drive signals to the first switching element, wherein a lamp filament heating voltage is generated in accordance with a duty ratio of the gate drive signal modulation.

10. The ballast of claim 9, the inverter circuit further comprising a gate drive transformer having a primary side coupled to the inverter driver, the gate drive transformer further having a first secondary side coupled to the first inverter switch and a second secondary side coupled to drive the first switching element in the filament voltage control block.

11. The ballast of claim 10, the filament voltage control block further comprising a third switching element coupled on a first side to the gate of the first switching element and on a second side to the second secondary of the gate drive transformer, the third switching element further arranged to be turned on in response to a first control signal state and enable the gate drive signals from the first gate drive output terminal to the first switching element of the filament voltage control block, the third switching element further arranged to be turned off in response to a second control signal state and disable the gate drive signals from the first gate drive output terminal to the first switching element of the filament voltage control block.

12. The ballast of claim 11, the third switching element further comprising an opto-coupler.

13. The ballast of claim 11, wherein the first and second switching elements of the filament voltage control block are driven at the same frequency as the inverter switches.

14. The ballast of claim 13, the filament voltage control block further comprising a primary winding of a filament heating transformer coupled to a node between the first and second switching elements of the filament voltage control block, and wherein a voltage generated across the primary winding of the filament heating transformer is independent of the driving frequency of the first and second switching elements.

15. The ballast of claim 14, further comprising one or more resonant tank circuits having a first end coupled to an inverter output terminal between the first and second inverter switches, each tank circuit coupled on a second end to one of a plurality of secondary windings of the filament heating transformer.

16. A method of operating an electronic ballast having an inverter circuit with first and second switching elements and a filament voltage control block with first and second switching elements, the method comprising:

determining a desired filament heating voltage to be supplied to a plurality of ballast output terminals based on an operating condition, the operating condition including one of a preheat condition, a startup condition, a dimming condition and a full lighting condition;

providing gate drive signals for driving each of the switching elements at a driving frequency associated with the operating condition;

modulating the gate drive signals to one or more of the switching elements in the filament voltage control block based on the desired filament heating voltage; and the filament voltage control block further having a third switching element coupled between the first switching element of the filament voltage control block and the inverter circuit providing the gate drive signals, wherein the step of modulating the gate drive signals to one or more of the switching elements in the filament voltage control block based on the desired filament heating voltage further comprises modulating the gate drive signals to the first switching element in the filament voltage control block by turning on and off the third switching element to enable and/or disable the gate drive signals based on the desired filament heating voltage.

17. The method of claim 16, wherein the third switching element is turned on and the gate drive signals are fully enabled in the preheat condition, wherein a maximum filament heating voltage is provided to the output terminals.

18. The method of claim 16, wherein the third switching element is turned off and the gate drive signals are fully disabled in the full lighting condition, wherein a minimum filament heating voltage is provided to the output terminals.

19. The method of claim 16, wherein the third switching element is turned on and off at a duty ratio associated with the desired filament heating voltage and the gate drive signals are partially enabled in the dimming condition, wherein a filament heating voltage between the minimum and maximum filament heating voltages is provided to the output terminals.

* * * * *